US007587844B1

(12) United States Patent
Palmer

(10) Patent No.: US 7,587,844 B1
(45) Date of Patent: Sep. 15, 2009

(54) NOVELTY APPARATUS

(76) Inventor: Robert G. Palmer, 2725 Ridgeway Dr., Wichita Falls, TX (US) 76306

( * ) Notice: Subject to any disclaimer, the term of this patent is extended or adjusted under 35 U.S.C. 154(b) by 481 days.

(21) Appl. No.: 11/539,605

(22) Filed: Oct. 6, 2006

(51) Int. Cl.
*G09F 3/18* (2006.01)

(52) U.S. Cl. ..... 40/1.5; 40/1.6; 40/799; 40/586; 24/3.11

(58) Field of Classification Search ..... 40/1.5, 40/1.6, 798, 799, 586; 24/3.11, 304
See application file for complete search history.

(56) References Cited

U.S. PATENT DOCUMENTS

| | | | | |
|---|---|---|---|---|
| 2,177,406 | A * | 10/1939 | Hacker | 40/1.5 |
| 3,596,757 | A | 8/1971 | Cocchlaraley | |
| 4,259,797 | A | 4/1981 | Belser | |
| 4,277,864 | A | 7/1981 | Orson, Sr. | |
| 5,843,551 | A | 12/1998 | Lee et al. | |
| D429,067 | S | 8/2000 | Kleinsmith | |
| D441,687 | S * | 5/2001 | Anderson | D11/95 |
| 6,484,424 | B1 * | 11/2002 | Peterson | 40/1.5 |
| 6,553,695 | B1 * | 4/2003 | Wang | 40/209 |
| 7,523,575 | B1 * | 4/2009 | Nettles | 40/661.04 |
| 2003/0041488 | A1 * | 3/2003 | Wu | 40/1.6 |
| 2006/0230501 | A1 * | 10/2006 | Roudeze | 2/265 |

* cited by examiner

*Primary Examiner*—Cassandra Davis

(57) ABSTRACT

A novelty apparatus that includes a birthday announcement and a number of money clips to which can be attached a paper form of money. The novelty apparatus includes a base and a frame that surrounds the base, with the base being either rectangular or square in nature. The base has a rear-mounted primary clip that can be used to attach the novelty apparatus to an item of clothing. The front side of the novelty apparatus has a front-mounted logo stating "Happy Birthday," along with a place where a numerical sticker indicative of age can optionally be placed. A number of clips organized in one or more rows are attached to the front side of the base to allow other individuals to attach paper money as gift offerings to the person who is experiencing the birthday.

3 Claims, 3 Drawing Sheets

NOVELTY APPARATUS

BACKGROUND OF THE INVENTION

The present invention concerns that of a new and improved novelty apparatus that includes a birthday announcement and a number of money clips to which can be attached a paper form of money.

DESCRIPTION OF THE PRIOR ART

U.S. Pat. No. 3,596,757, issued to Cocchlaraley, discloses a coin-holding device for holding a limited number of coins, mounted within the framework of a paper money clip.

U.S. Pat. No. D429,067, issued to Kleinsmith, discloses an ornamental design for a combination card case and money clip.

U.S. Pat. No. 5,843,551, issued to Lee et al., discloses a money cake apparatus which gives the appearance of cash money being pulled from a birthday cake.

U.S. Pat. No. 4,277,864, issued to Orson, Sr., discloses an integral synthetic plastic spring clip used for attaching identification badges and the like to garments.

U.S. Pat. No. 4,259,797, issued to Belser, discloses a transparent convention badge holder of the type having front and rear panels and seals securing the panels to one another.

SUMMARY OF THE INVENTION

The present invention concerns that of a new and improved novelty apparatus that includes a birthday announcement and a number of money clips to which can be attached a paper form of money. The novelty apparatus includes a base and a frame that surrounds the base, with the base being either rectangular or square in nature. The base has a rear-mounted primary clip that can be used to attach the novelty apparatus to an item of clothing. The front side of the novelty apparatus has a front-mounted logo stating "Happy Birthday," along with a place where a numerical sticker indicative of age can optionally be placed. A number of clips organized in one or more rows are attached to the front side of the base to allow other individuals to attach paper money as gift offerings to the person who is experiencing the birthday.

There has thus been outlined, rather broadly, the more important features of a novelty apparatus that the detailed description thereof that follows may be better understood and in order that the present contribution to the art may be better appreciated. There are, of course, additional features of the novelty apparatus that will be described hereinafter and which will form the subject matter of the claims appended hereto.

In this respect, before explaining at least one embodiment of the novelty apparatus in detail, it is to be understood that the novelty apparatus is not limited in its application to the details of construction and to the arrangements of the components set forth in the following description or illustrated in the drawings. The novelty apparatus is capable of other embodiments and being practiced and carried out in various ways. Also, it is to be understood that the phraseology and terminology employed therein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present novelty apparatus. It is important, therefore, that the claims be regarded as including such equivalent constructions insofar as they do not depart from the spirit and scope of the present invention.

It is therefore an object of the present invention to provide a novelty apparatus which has all of the advantages of the prior art and none of the disadvantages.

It is another object of the present invention to provide a novelty apparatus which may be easily and efficiently manufactured and marketed.

It is another object of the present invention to provide a novelty apparatus which is of durable and reliable construction.

It is yet another object of the present invention to provide a novelty apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
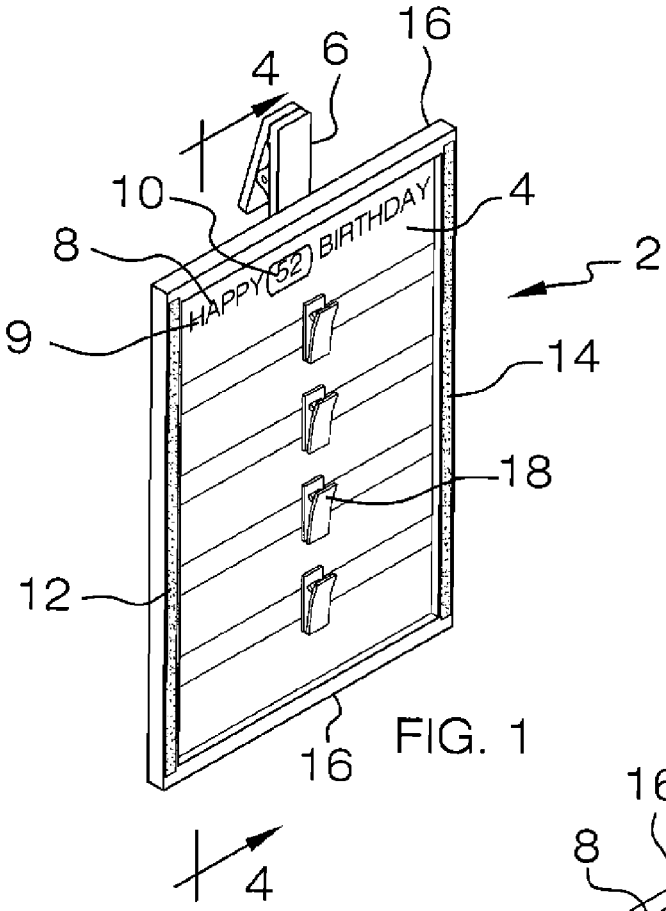
FIG. 1 shows a perspective view of the novelty apparatus as it would appear in use.
Figure 2:
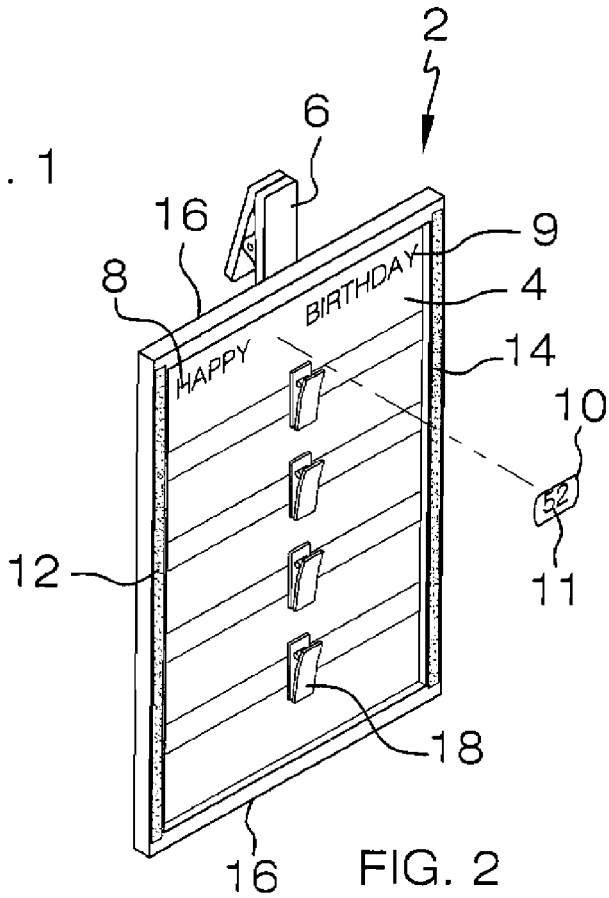
FIG. 2 shows a perspective view of the novelty apparatus as it would appear in use with an age sticker being attached to the front surface of the base of the novelty apparatus.
Figure 3:
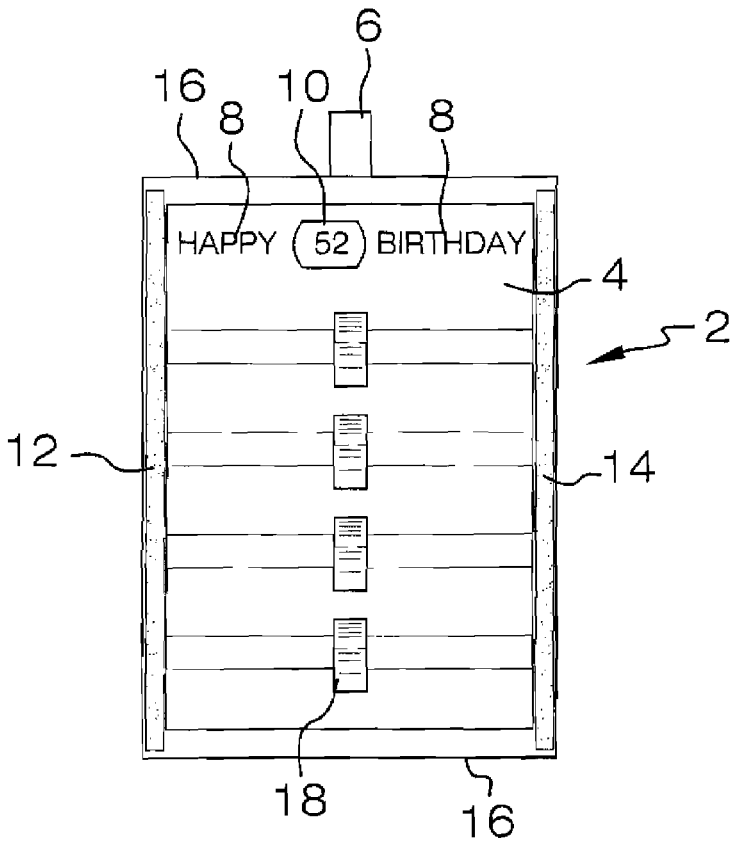
FIG. 3 shows a front view of the novelty apparatus as it would appear in use.
Figure 4:
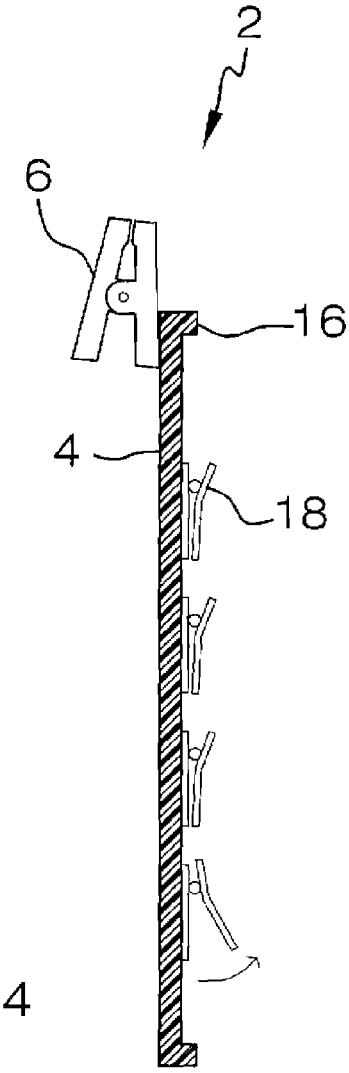
FIG. 4 shows a side view of the novelty apparatus as it would appear in use.
Figure 5:
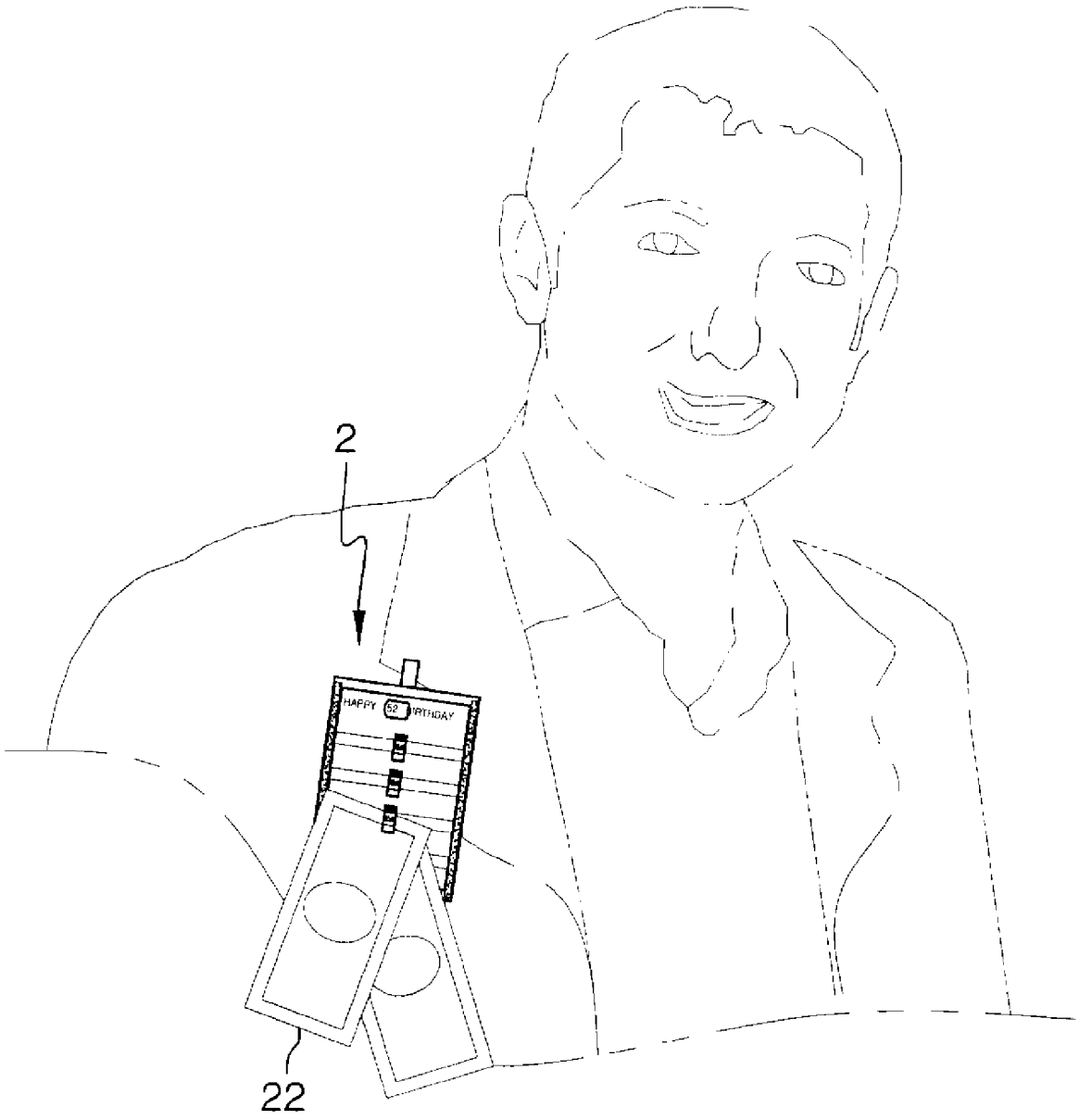
FIG. 5 shows a perspective view of the novelty apparatus as it would appear in use, attached to an item of clothing worn by an individual.

With reference now to the drawings, and in particular to FIGS. 1 through 5 thereof, a new novelty apparatus embodying the principles and concepts of the present invention and generally designated by the reference numeral 2 will be described.

As best illustrated in FIGS. 1 through 5, the novelty apparatus 2 comprises a base 4 that has two surfaces comprising an front surface and a rear surface. The base 4 itself is preferably square or rectangular in shape.

The novelty apparatus 2 further includes a primary clip 6 that is attached to the rear surface of the base 4. The purpose of the primary clip 6 is to allow the novelty apparatus 2 to be attached to an item of clothing for purposes of displaying to other individuals that the wearer of the novelty apparatus 2 is having a birthday on that given day.

The base 4 itself is given structure and is held in place by an external frame 16 that surrounds and envelops the base 4. Attached to the frame 16 are a pair of adhesive strips 12 and 14 that allow additional items to be attached to the novelty apparatus 2 as needed and/or desired.

The base 4 further includes a logo 8 that is comprised of writing 9, with the writing preferably stating "Happy Birthday." In between the Happy and Birthday of this logo, an age sticker 10 can be placed, with the age sticker 10 designed to indicate how old the wearer of the novelty apparatus 2 is on the particular day that it is being worn. The age sticker 10 has a number 11 on it that correlates with the wearer's age.

The base 4 of the novelty apparatus 2 further comprises a plurality of money clips 18 that are fixedly attached to the base 4. These money clips are designed to be organized in one, two, or three columns, preferably in columns numbering four money clips 18 each.

Ideally, when the novelty apparatus 2 is being worn by an individual on an item of clothing, other friends, co-workers, acquaintances, and related people will attach paper money 22 to one of the money clips 18 that are on the front surface of the base 4. The individual can then utilize the paper money 22 at a later time as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A novelty apparatus comprising:

a base having two surfaces comprising a front surface and a rear surface, the base itself having a rectangular or square shape, an external frame that surrounds and envelops the base, a logo placed on the base, the logo comprising writing, attachment means for attaching the base to an item of clothing, wherein the apparatus further comprises an age sticker, the age sticker being placed on the front surface of the base, wherein the apparatus further comprises means for attaching additional objects to the front surface of the base, wherein the means for attaching additional objects to the front surface of the base further comprises a pair of adhesive strips, wherein the adhesive strips are attached to the frame, wherein the attachment means for attaching the base to an item of clothing further comprises a primary clip, the primary clip being attached to the rear surface of the base, wherein an individual can removably attach the primary clip to an item of clothing, wherein the logo comprises writing that states "Happy Birthday", wherein the apparatus further comprises a plurality of money clips, the money clips being attached to the front surface of the base.

2. A novelty apparatus according to claim 1 wherein the plurality of money clips attached to the front surface of the base are organized into at least one column.

3. A novelty apparatus according to claim 2 wherein each of the columns of money clips present on the front surface of the base comprise four money clips.

* * * * *